US009695000B2

(12) United States Patent
Mizuguchi

(10) Patent No.: US 9,695,000 B2
(45) Date of Patent: Jul. 4, 2017

(54) SHEET FEEDING DEVICE AND IMAGE FORMING APPARATUS

(71) Applicant: KYOCERA Document Solutions Inc., Osaka (JP)

(72) Inventor: Keisuke Mizuguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/137,180

(22) Filed: Apr. 25, 2016

(65) Prior Publication Data

US 2016/0318723 A1 Nov. 3, 2016

(30) Foreign Application Priority Data

Apr. 28, 2015 (JP) ..... 2015-091101

(51) Int. Cl.

| | |
|---|---|
| ***B65H 5/06*** | (2006.01) |
| ***B65H 3/52*** | (2006.01) |
| ***B65H 3/06*** | (2006.01) |
| ***B65H 3/68*** | (2006.01) |

(52) U.S. Cl.

CPC ..... *B65H 3/5261* (2013.01); *B65H 3/0684* (2013.01); *B65H 3/5215* (2013.01); *B65H 3/68* (2013.01); *B65H 5/062* (2013.01); *B65H 2402/32* (2013.01); *B65H 2402/64* (2013.01); *B65H 2601/324* (2013.01)

(58) Field of Classification Search

CPC ..... B65H 3/5261; B65H 2404/144; B65H 3/0607

USPC ..... 271/273–274

See application file for complete search history.

(56) References Cited

U.S. PATENT DOCUMENTS

| | | | | |
|---|---|---|---|---|
| 7,641,188 | B2 * | 1/2010 | Hiura | B65H 3/06 271/122 |
| 2010/0032893 | A1 * | 2/2010 | Koga | B65H 3/5261 271/110 |
| 2011/0156340 | A1 * | 6/2011 | Otsuki | B65H 1/04 271/10.09 |
| 2015/0115520 | A1 * | 4/2015 | Uohashi | B65H 1/266 271/121 |
| 2015/0183597 | A1 * | 7/2015 | Kobayashi | B65H 3/0684 271/111 |

FOREIGN PATENT DOCUMENTS

JP 2011-190077 A 9/2011

* cited by examiner

*Primary Examiner* — Jeremy R Severson

(74) *Attorney, Agent, or Firm* — Studebaker & Brackett PC

(57) ABSTRACT

A sheet feeding device includes a holder member and a stopper member. The holder member is configured to house a separating member and to be attached to or detached from a conveying guide by being slid in a vertical direction. The stopper member is configured to be attached to or detached from the conveying guide by being slid in a vertical direction outside of the holder member. The stopper member has an engaged part. The holder member has an engaging part with which the engaged part is to be engaged. The holder member is attached to the conveying guide by being slid from the above side. The stopper member is attached to the conveying guide by being slid from the above side while engaging the engaged part with the engaging part. The stopper member prevents the holder member from being moved with respect to the conveying guide.

10 Claims, 10 Drawing Sheets

SHEET FEEDING DEVICE AND IMAGE FORMING APPARATUS

INCORPORATION BY REFERENCE

This application is based on and claims the benefit of priority from Japanese Patent application No. 2015-091101 filed on Apr. 28, 2015, the entire contents of which are incorporated herein by reference.

BACKGROUND

The present disclosure relates to a sheet feeding device which conveys a sheet and an image forming apparatus including the sheet feeding device.

An image forming apparatus, such as a copying machine or a printer, is provided with a sheet feeding device which conveys a sheet from a sheet feeding cartridge. The sheet feeding device has a retard roller which prevents overlapped sheets from being conveyed (multiple feeding) and conveys the sheets one by one. The retard roller prevents the multiple feeding by applying a frictional force to the sheets other than an uppermost sheet.

Since the retard roller is configured to prevent the multiple feeding of the sheets by frictionally rubbing against the sheets, this roller is necessarily frictionally worn by the rubbing against the sheets. If such frictional wearing advances, since a sheet feeding failure, such as a multiple feeding, is easy to occur, it is necessary to replace or repair the retard roller periodically.

As a solution to the problem described above, there is a sheet feeding device provided with a holder member which holds the retard roller. The sheet feeding device is configured to attach or detach the holder member to or from a guiding part which guides a sheet fed from the sheet feeding cartridge. The guiding part has a depression in which the holder member is to be housed. On both side surfaces of the holder member, elastic connection pieces capable of engaging with the depression are formed. By elastically deforming the connection pieces, the holder member is attached to or detached from the depression. Also, the sheet feeding device is further provided with a charging member which is charged between the side surfaces of the depression and side surfaces of the holder member in order to prevent the connection pieces from being elastically deformed after the holder member has been attached to the depression.

However, in the sheet feeding device mentioned above, there is a need to deform the connection pieces by putting one's fingers in a small space between the side surfaces of the depression and the side surfaces of the holder member, and there has been cumbersomeness associated with attachment and detachment of the holder member. In addition, there is a need to carry out the work of attaching the charging member in the small space and thus further cumbersomeness is prone to arise.

SUMMARY

In accordance with an embodiment of the present disclosure, a sheet feeding device includes a feeding member, a separating member, a conveying guide, a holder member and a stopper member. The feeding member is configured to convey an uppermost sheet in stored sheets along a conveying path. The separating member is configured to be pressed against the feeding member to separate the uppermost sheet from the other sheets. The conveying guide is configured to guide the separated sheet by the separating member along the conveying path. The holder member is configured to house the separating member and to be attached to or detached from the conveying guide by being slid in a vertical direction. The stopper member is configured to be attached to or detached from the conveying guide by being slid in a vertical direction outside of the holder member and to prevent the holder member from being moved with respect to the conveying guide. The stopper member has an engaged part. The holder member or the conveying guide has an engaging part with which the engaged part is to be engaged. The holder member is attached to the conveying guide by being slid from the above side. Then, the stopper member is attached to the conveying guide by being slid from the above side while engaging the engaged part with the engaging part. The stopper member positions the holder member with respect to the conveying guide and prevents the holder member from being moved with respect to the conveying guide.

In accordance with an embodiment of the present disclosure, an image forming apparatus includes the above described sheet feeding device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, a sheet feeding device and an image forming apparatus according to an embodiment of the present disclosure will be described.

Figure 1:
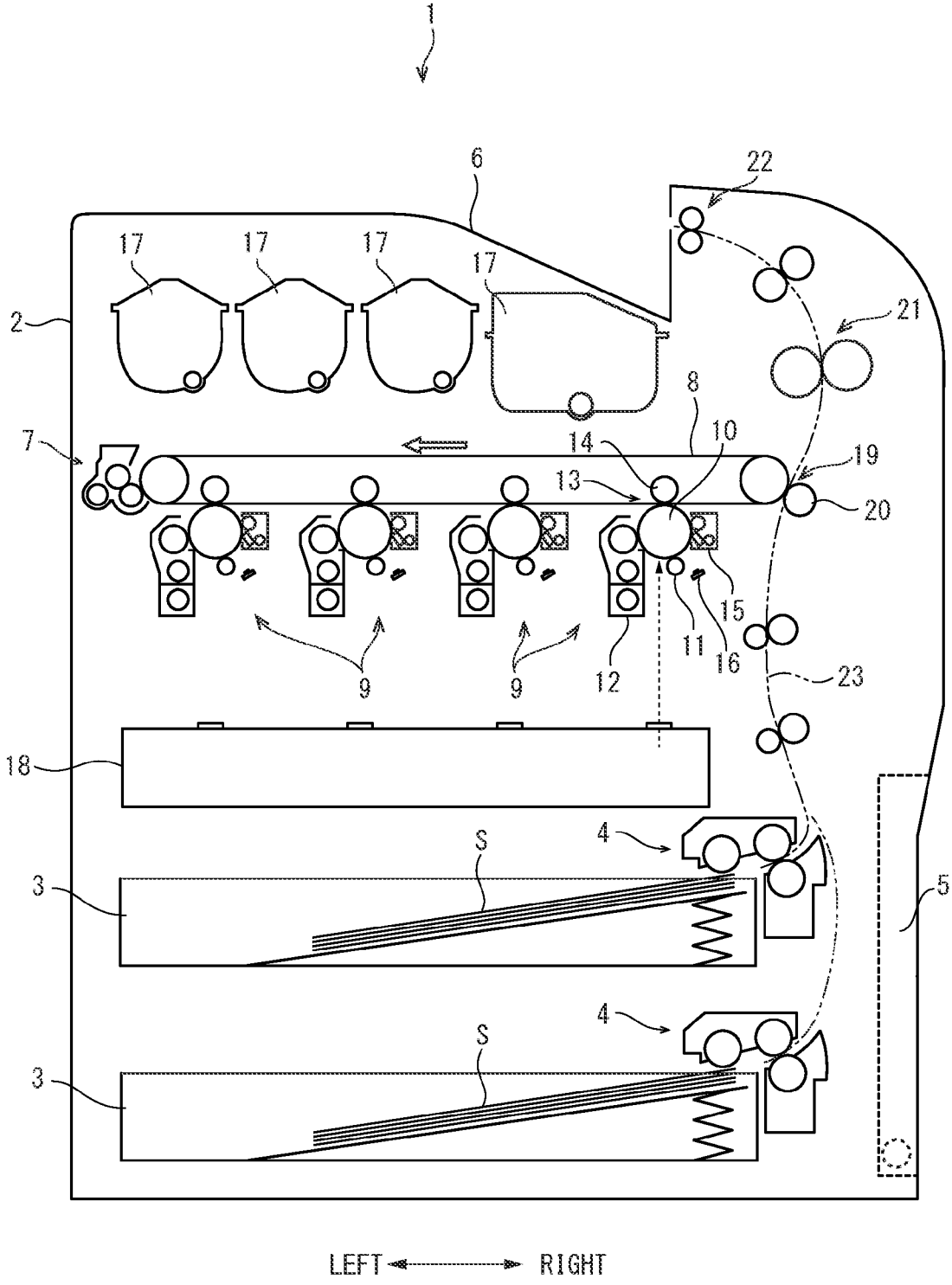
FIG. 1 is a front view schematically showing an internal structure of a color printer according to an embodiment of the present disclosure.

First, with reference to FIG. 1, an entire structure of a color printer 1 (image forming apparatus) will be described. FIG. 1 is a schematic diagram schematically showing an inside structure of the color printer according to an embodiment of the present disclosure. In the following description, a front side of the sheet plane of FIG. 1 shows a front side of the color printer 1 and left and right directions are based on a direction viewed from the front side of the color printer 1.

The color printer 1 has a rectangular parallelepiped shaped printer main body 2. In a lower part of the inside of the printer main body 2, sheet feeding cartridges 3 are stored arranged in the vertical direction. The sheet feeding cartridge 3 stores sheets S of different size. At an upper right side of each of the sheet feeding cartridges 3, a sheet feeding device 4 configured to feed the sheet from the sheet feeding cartridge 3 is provided. On a right side plate of the printer main body 2, a covering member 5 is formed turnably around its lower end. By turning the covering member 5, each of the sheet feeding devices 3 can be handled. On an upper surface of the printer main body 2, an ejected sheet tray 6 is formed.

Inside of the printer main body 2, an intermediate transferring unit 7 is provided. The intermediate transferring unit 7 includes an intermediate transferring belt 8 bridged between a plurality of rollers and four image forming parts 9 respectively corresponding to four toner colors (four colors of magenta, cyan, yellow and black) arranged along the lower side of the intermediate transferring belt 8. Each of the image forming parts 9 has a photosensitive drum 10 rotatably. Around the photosensitive drum 10, a charger 11, a development device 12, a first transferring roller 14 which forms a first transferring part 8 with the intermediate transferring belt 8, a cleaning device 15 and a static eliminator 16 are arranged along a rotation direction of the photosensitive drum 10. Above each image forming part 8, a toner container 17 storing toner of corresponding color is attached.

Under the image forming parts 8, an exposure device 18 containing a laser scanning unit (LSU) is provided. On a right end of the intermediate transferring unit 7, a second transferring roller 20 is provided to forma second transferring part 19 with the intermediate transferring belt 8. Above the second transferring part 19, a fixing device 21 is provided. Above the fixing device 21, a sheet ejecting device 22 facing the ejected sheet tray 6 is provided. Inside of the printer main body 2, a sheet conveying path 23 is formed from each of the sheet feeding device 4 to the sheet ejecting device 22 through the second transferring part 19 and the fixing device 18.

Next, the operation of forming an image by the color printer 1 having such a configuration will be described. After a surface of the photosensitive drum 10 is charged by the charger 11, the exposure device 18 exposes the surface of the photosensitive drum 10 with a laser light (refer to an arrow p in FIG. 1) to form an electrostatic latent image on the surface of the photosensitive drum 10. The electrostatic latent image is then developed into a toner image of corresponding color by the developing device 12. The toner image is first-transferred on the intermediate transferring belt 8 at the first transferring part 13. The above-mentioned operation is repeated in order by the image forming parts 8, thereby forming a full color toner image onto the intermediate transferring belt 8. Incidentally, toner and residual electric charge remained on the photosensitive drum 10 are removed by the cleaning device 15 and the static eliminator 16, respectively.

On the other hand, the sheet fed from the sheet feeding cartridge 3 by the sheet feeding device 4 is conveyed to the second transferring part 9 in a suitable timing for the above-mentioned image forming operation. Then, in the second transferring part 19, the full color toner image on the intermediate transferring belt 8 is second-transferred onto the sheet. The sheet with the second-transferred toner image is conveyed to a downstream side along the sheet conveying path 23 to enter the fixing device 21 and then, the toner image is fixed on the sheet in the fixing device 21. The sheet with the fixed toner image is ejected from the sheet ejecting device 22 onto the ejected sheet tray 6.

Figure 2:
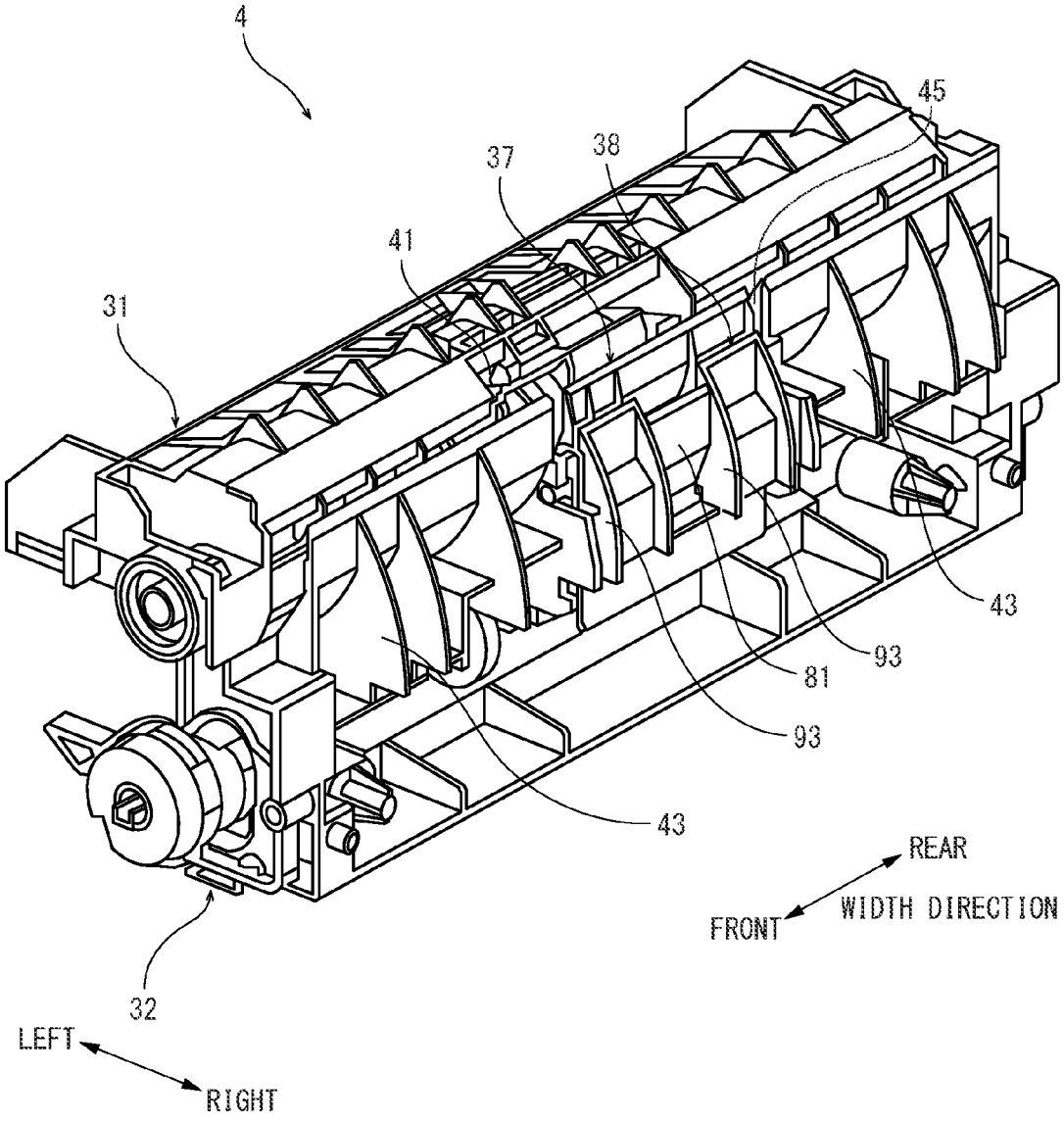
FIG. 2 is a perspective view showing a sheet feeding device according to an embodiment of the present disclosure.
Figure 3:
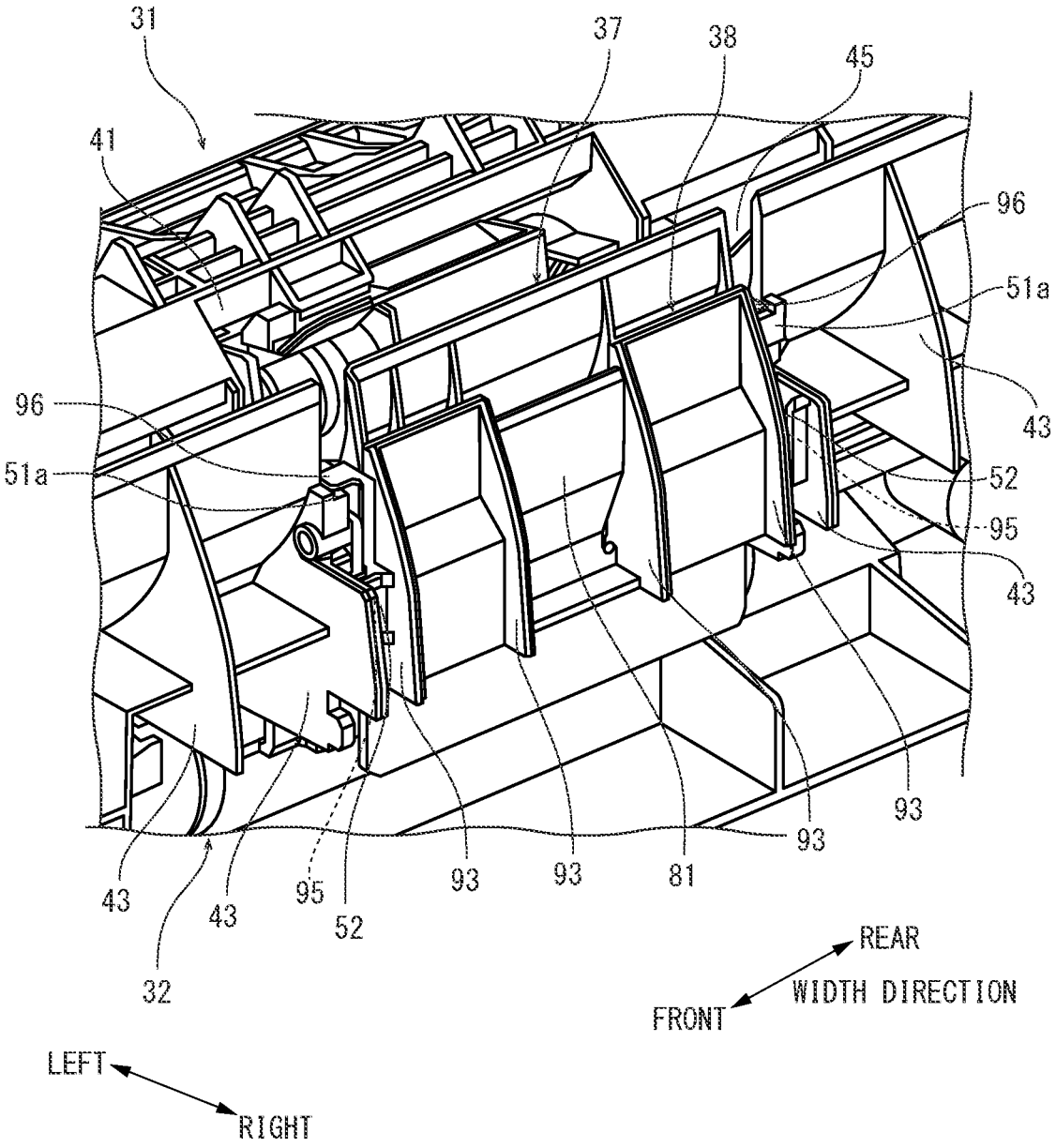
FIG. 3 is an enlarged perspective view showing a vicinity around a center in front and rear directions of the sheet feeding device according to the embodiment of the present disclosure.
Figure 4:
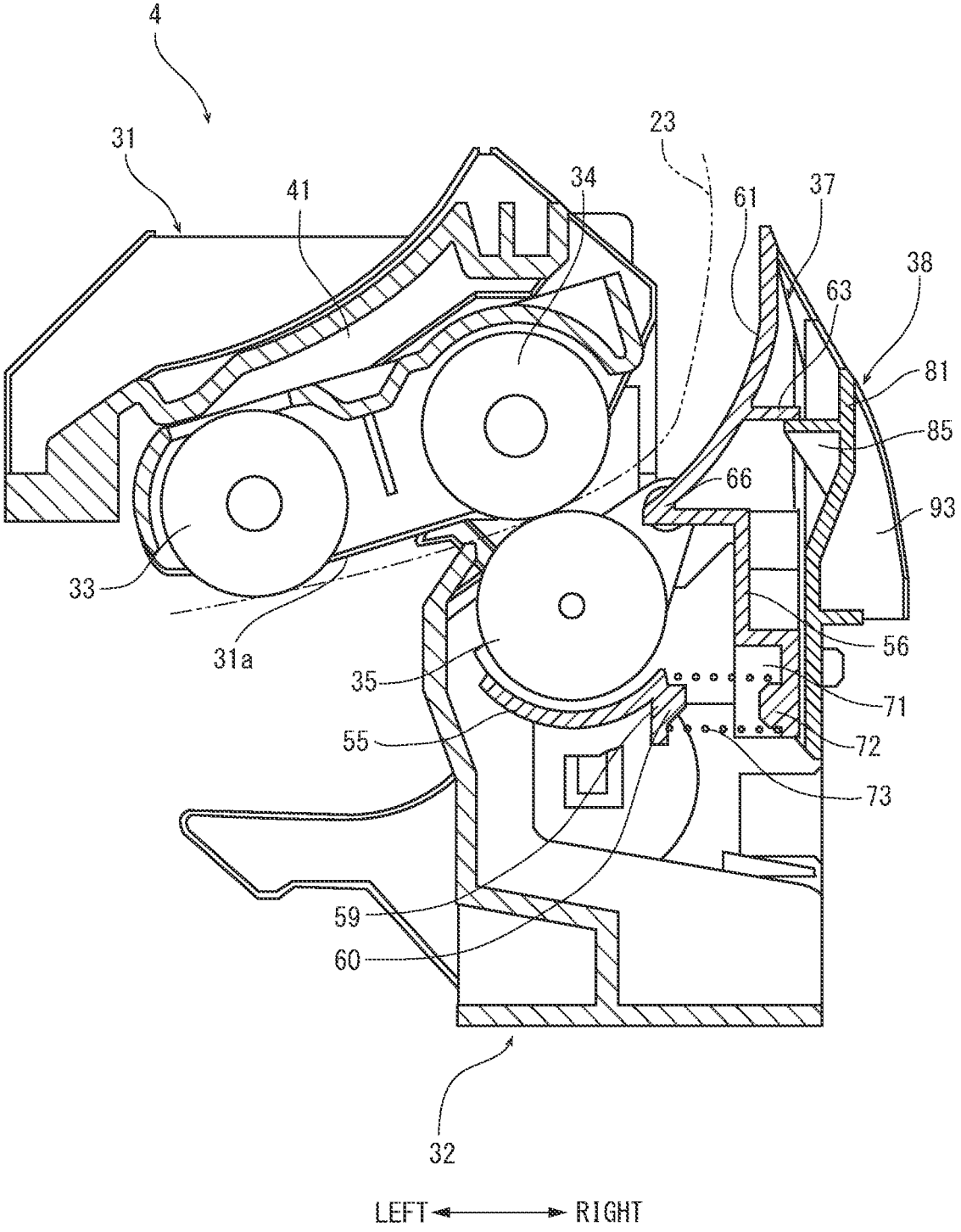
FIG. 4 is a sectional front view showing the sheet feeding device according to the embodiment of the present disclosure.

Next, with reference to FIG. 2 to FIG. 4, the sheet feeding device 4 will be described. FIG. 2 is a perspective view showing the sheet feeding device; FIG. 3 is an enlarged perspective view showing a vicinity around a center in front and rear directions of the sheet feeding device; and FIG. 4 is a sectional front view showing the sheet feeding device.

The sheet feeding device 4 is provided with an upper conveying guide 31, a lower conveying guide 32 (conveying guide), a pickup roller 33, a feed roller 34 (feeding member), a retard roller 35 (separating member), a holder member 37 and a stopper member 38. The upper conveying guide 31 and the lower conveying guide 32 are respectively disposed on an upper side and a lower side of the conveying path 23 and each have a guiding surface of the sheet. The pickup roller 33 and the feed roller 34 are supported by the upper conveying guide 31. The retard roller 35 is supported by the lower conveying guide 32. The holder member 37 houses the retard roller 35. The stopper member 38 supports the holder member in the lower conveying guide 32 without being moved.

The upper conveying guide 31 is arranged along a width direction of the sheet perpendicular to the conveying direction. On a lower surface of the upper conveying guide 31, a plurality of ribs inclined in an oblique upper direction toward the downstream side in the conveying direction are formed. These ribs form the upper guiding surface 31*a* of the conveying path 23. In addition, on the lower surface of the upper conveying guide 31, a roller housing part 41 is formed at a center in the width direction.

The pickup roller 33 and the feed roller 34 are housed in the roller housing part 41. The pickup roller 33 and the feed roller 34 are disposed in this order from the upstream side in the conveying direction and are supported to be rotated in the direction along the conveying direction by a driving source (not shown). The pickup roller 33 feeds out the sheet from the sheet feeding cartridge 3 and the feed roller 34 conveys the fed out sheet toward the downstream side in the conveying path 23.

The lower conveying guide 32 is arranged along the sheet width direction under the upper conveying guide 31. A left surface (refer to FIG. 5) of the lower conveying guide 32 curves in an oblique upper direction toward the downstream side in the conveying direction to form the lower guiding surface 32*a* of the conveying path 23. In addition, on a right surface of the lower conveying guide 32, a plurality of ribs 43 (refer to FIG. 3) which curve toward a tip end of the lower guiding face 32*a* are formed. These ribs 43 forma guiding surface which guides the sheets stored in the lower sheet feeding cartridge 3 along the conveying direction. Furthermore, on the left surface of the lower conveying guide 32, a holder housing part 45 depressed downward is formed at a center in the width direction.

Figure 5:
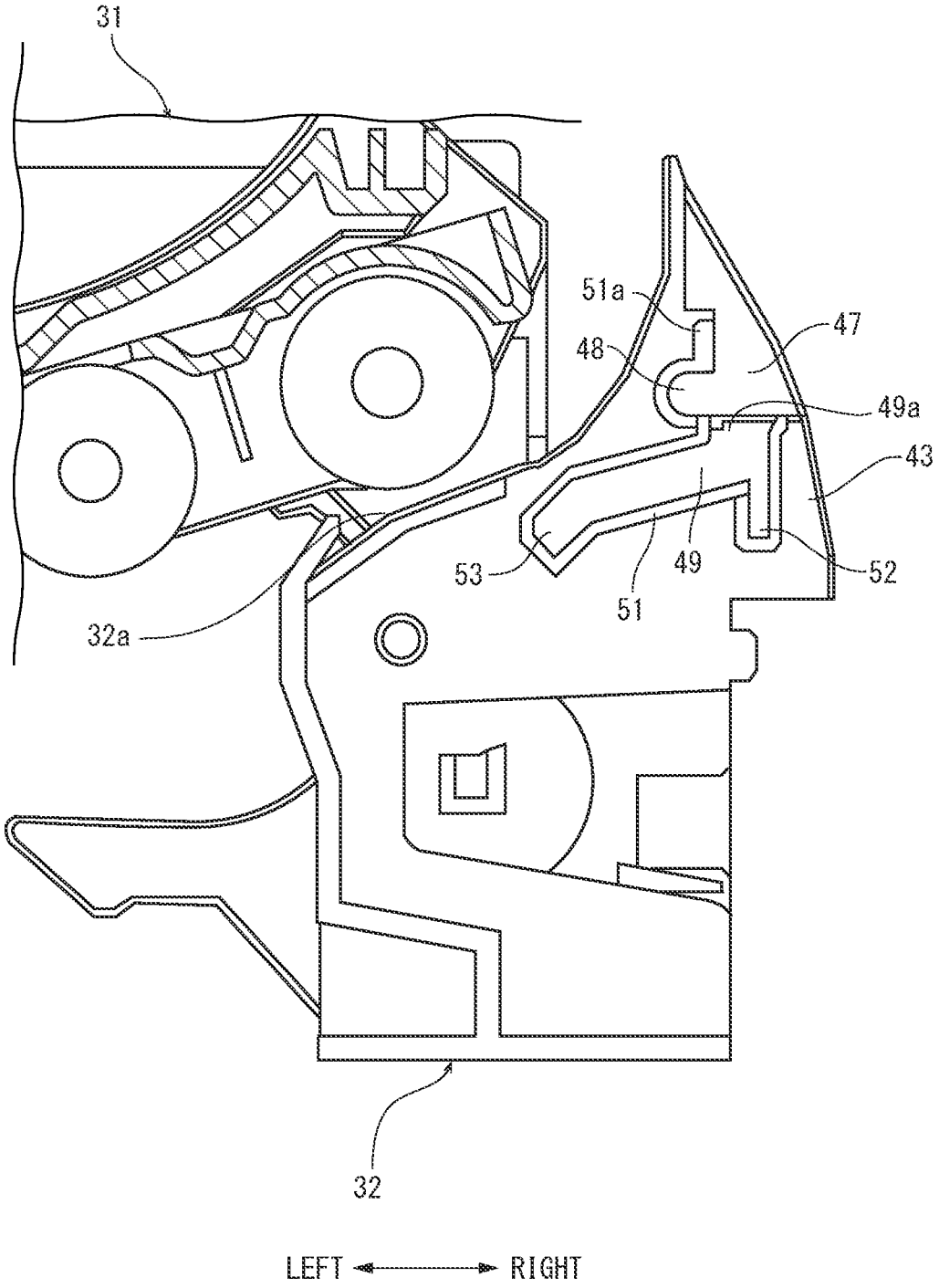
FIG. 5 is a sectional front view showing a depression of a lower conveying guide in the sheet feeding device according to the embodiment of the present disclosure.
Figure 6:
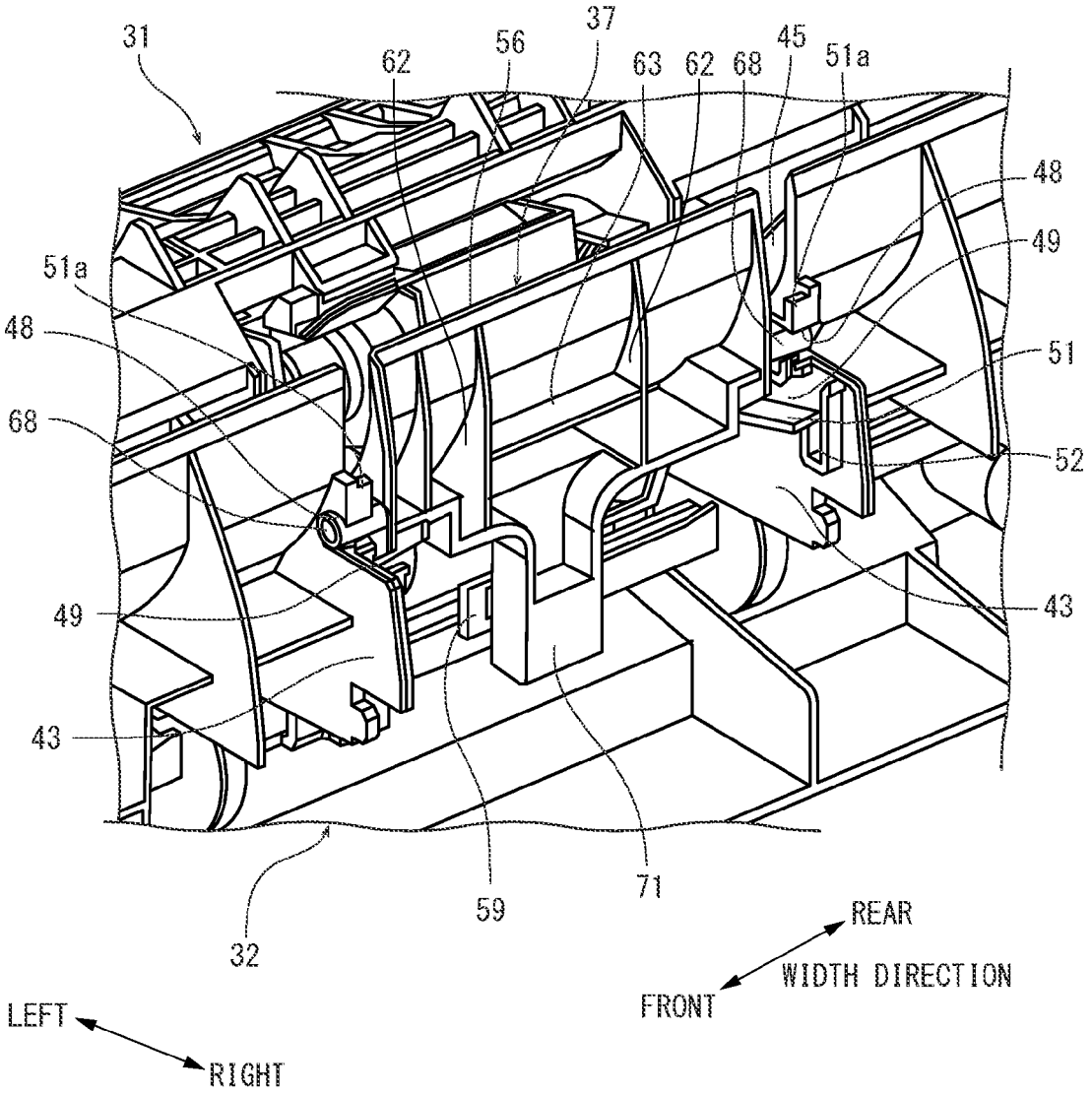
FIG. 6 is a perspective view showing the depression of the lower conveying guide in the sheet feeding device according to the embodiment of the present disclosure.

With reference to FIG. 5 and FIG. 6, the holder housing part 45 will be described. FIG. 5 is a front view showing a side surface of the holder housing part and FIG. 6 is a perspective view showing the holder housing part.

As shown in FIG. 5, the holder housing part 45 is formed between two of the ribs 43. In each of the ribs 43, a triangular notch 47 is formed in its substantial upper half portion. At a lower portion of a left edge of each notch 47, a first engagement recessed part 48 of a semicircular shape is formed. Further, on opposed surfaces of the two ribs 43, a guiding groove 49 and an engagement groove 52 are formed.

The guiding groove 49 and the engagement groove 52 are integrally formed by surrounding their peripheries with a projected stripe 51. The guiding groove 49 inclines in a left and lower oblique direction from an opening 49*a* formed at a lower edge of the notch 47. At a terminal end of the guiding groove 49, a second engagement recessed part 53 (engagement recess) inclining in the left and lower direction is formed. The engagement groove 52 extends straightly downward on the right side of the opening 49*a*. A width of the engagement groove 52 is smaller than a width of the guiding groove 49. Also, the projected stripe 51 extends upward along a peripheral edge of the first engagement recessed part 48 and the left edge of the notch 47 until a vicinity of a center in the vertical direction of the notch 47.

Figure 7:
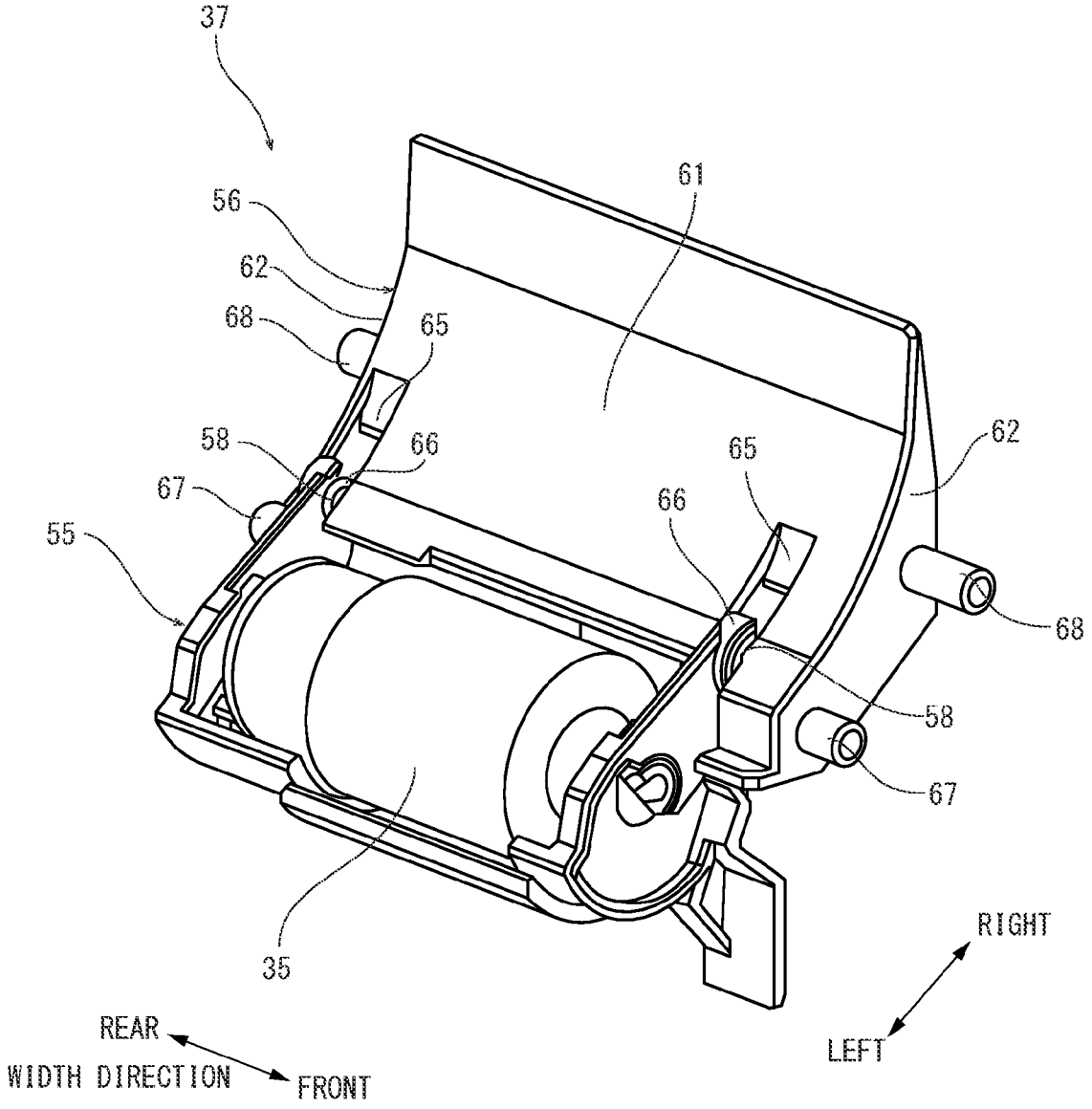
FIG. 7 is a perspective vie showing a holder member in the sheet feeding device according to the embodiment of the present disclosure.

With reference to FIG. 6 and FIG. 7, the holder member 37 will be described. FIG. 7 is a perspective view showing the holder member. The holder member 37 has a housing part 55 in which the retard roller 35 is to be housed and a guiding part 56 forming a guiding surface of the sheet. The holder member 37 is detachably attached to the holder housing part 45 of the lower conveying guide 32.

The housing part 55 has a semi-cylindrical shape of a length corresponding to a length of the retard roller 35. At corners of both side surfaces in the width direction of the housing part 55, substantially semicircular bearings 58 are coaxially formed. Also, as shown in FIG. 4, on a lower surface of the housing part 55, an extended part 59 protruding downward from a center in the width direction is formed. On a right surface of the extended part 59, a boss 60 is formed.

The retard roller 35 is housed in the housing part 55, and both ends of a rotating shaft of the retard roller 35 are supported on both side surfaces of the housing part 55. The retard roller 35 is provided with a torque limiter so as not to be rotated until a torque exceeding a predetermined torque is applied and to idle with respect to the rotating shaft when a torque exceeding the predetermined torque is applied.

The guiding part 56, as shown in FIG. 7, has a guiding surface 61 which curves along the conveying path 23. In addition, as shown in FIG. 6, on an opposite surface to the guiding surface 61, a plurality of ribs 62 extending in the vertical direction are formed. Between two ribs 62 formed at a center portion in the width direction, a horizontal rib 63 (engaging part, engaging piece) extending in a horizontal direction is formed.

As shown in FIG. 7, on both ends in the width direction of a lower edge of the guiding part 56, slit-shaped notches 65 each extending in the conveying direction are formed. At a substantial center of each notch 65, a shaft part 66 is coaxially formed.

In addition, on outside surfaces of the outermost ribs 62 in the width direction, a first boss 67 (engagement projection) and a second boss 68 are formed each protruding coaxially. The first boss 67 is formed on a left end portion of the side surface of the rib 62, and the second boss 68 is formed on a right end portion of the side surface of the rib 62. A length of the first boss 67 is shorter than a length of the second boss 68. Further, on a lower surface of the guiding part 56, as shown in FIG. 4 and FIG. 6, an extended part 71 protruding downward from a substantial center in the width direction is formed. On a left surface of the extended part 71, a boss 72 is formed.

With each bearing 58 of the housing part 55, each shaft part 66 of the guiding part 56 is rotatably supported. In this manner, the housing part 55 is swingably supported around the shaft part 66 with respect to the guiding part 56. In addition, as shown in FIG. 4, a coil spring 73 is interposed between the boss 60 formed on the extended part 59 of the housing part 55 and the boss 72 formed on the extended part 71 of the guiding part 56 so as to bias the housing part 55 in the clockwise direction around the shaft part 66 with respect to the guiding part 56. In this manner, the retard roller 35 stored in the housing part 55 is brought into pressure contact with the feed roller 34 stored in the roller housing part 41 of the upper conveying guide 31 at an appropriate nipping pressure.

Figure 8:
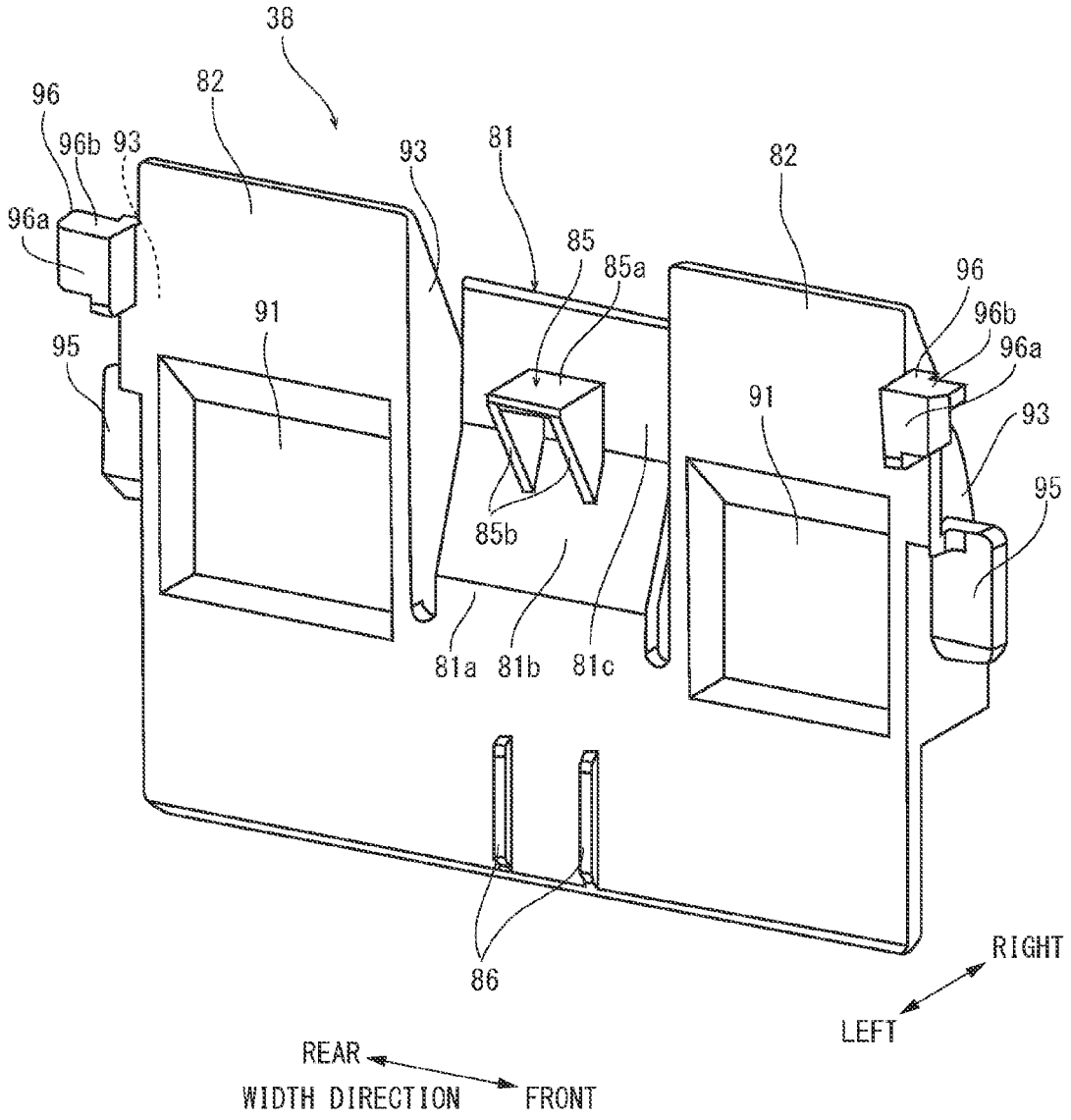
FIG. 8 is a perspective view showing a stopper member in the sheet feeding device according to the embodiment of the present disclosure.

With reference to FIG. 8, the stopper member 38 will be described. FIG. 8 is a perspective view showing the stopper member. The stopper member 38 is a flat plate-shaped member having a width corresponding to a width of the holder member 37.

The stopper member 38 is formed with an elastic piece (engaged part) separated with parallel slits extending downward from a center portion of an upper edge in the width direction. The elastic piece 81 is formed to be lower in height than a fixed piece 82 on each side of the elastic piece 81 in the width direction. The elastic piece 81 has; a proximal portion 81*a* extending on a same plane as that of the fixed piece 82; a center portion 81*b* inclining in the right and upper oblique direction from a tip edge of the proximal portion 81*a*; and a tip portion 81*c* extending in parallel to the proximal portion 81*a* from a tip edge of the center portion 81*b*. The elastic piece 81 is elastically deformable in the left and right directions around the proximal portion 81*a*. Also, a claw part 85 is protruded at the boundary between the center portion 81*b* and the tip portion 81*c* on the left surface of the elastic piece 81. The claw part 85 protrudes leftward from the left surface of the fixed piece 82. The claw part 85 has: a horizontal top surface 85*a*; and an inclined surface 85*b* inclining in the right and lower oblique direction from a front edge of the top surface 38. In addition, on the left surface of the stopper member 38, a pair of parallel ribs 86 extending in the vertical direction are formed under the elastic piece 81.

In each fixed pieces 82, a rectangular depression 91 depresses rightward from the left surface is formed. Also, from side edges of each fixed piece 82, ribs 93 protruding rightward are formed. Each rib 93 is formed in a substantial right triangle in front view. A right side edge of the rib 93 curves in the left and upper oblique direction. When the stopper member 38 is attached to the lower conveying guide 32, a tip edge of the elastic piece 81 and the right side edge of each rib 93 are formed along the same outline as that of the right side edge of the rib 43 of the lower conveying guide 32.

On outside surfaces of the outermost ribs 93 in the width direction, a first protruding piece 95 (protruding piece) and a second protruding piece 96 are formed. The first protrusive piece 95 of a vertically elongated flat shape is formed on a lower portion of the outside surface of the rib 93. The second protrusive piece 96 protrudes leftward from the left surface of the fixed piece 82, and has a left wall 96*a* and a top wall 96*b* which are orthogonal to each other. The second protruding piece 96 is formed on a left and upper side of the first protruding piece.

In the sheet feeding device 4 having the above mentioned configuration, a procedure for unmovably supporting the holder member 37 on the lower conveying guide 32 with the stopper member 38 will be given. In the first step, the holder member 37 in which the retard roller 35 has been housed is supported on the holder housing part 45 of the lower conveying guide 32. First, the holder member 37 is fitted into the holder housing part 45 from the above side, and the first bosses 67 formed on the guiding part 56 are inserted into the guiding grooves 49 through the openings 49*a*. The first bosses 67 are guided leftward along the guiding grooves 49 and engage with the second engagement recessed parts 53. At the same time, the second bosses 68 engage with the first engagement recessed parts 48. Afterward, the coil spring 73 is interposed between the boss 60 formed on the extended part 59 of the housing part 55 and the boss 72 formed on the extended part 71 of the guiding part 56. Then, the housing part 55 is biased in the clockwise direction by the coil spring 73, and the retard roller 35 supported in the housing part 55 is brought into pressure contact with the feed roller 34 at the predetermined nipping pressure.

Next, the stopper member 38 is attached to the holder housing part 45 of the lower conveying guide 32. When the stopper member 38 is fitted into the holder housing part 45 from the above side on the right side of the attached holder member 37, the first protruding pieces 95 of the stopper member 38 are engaged with the engagement grooves 52 through the notches 47 of the ribs 43 of the holder housing part 45. Also, the second protruding pieces 96 are engaged with upper ends 51*a* of the projected stripes 51 of the ribs 43. When the first protruding pieces 95 and the second protruding pieces 96 are respectively engaged with the engagement grooves 52 and the upper ends 51*a* of the projected stripes 51, the inclined surface 85*b* of the claw part 85 formed on the elastic piece 81 abuts against the horizontal rib 63 of the holder member 37. Then, the elastic piece 81 gradually elastically deforms rightward and then reverts into its original shape after the claw part 85 is passed through the horizontal rib 63. And, the craw part 85 is engaged with the horizontal rib 63 in a snap-fitting manner (engaged by way of engagement utilizing a material elasticity). In addition, the extended part 71 of the holder member 37 is positioned between the pair of ribs 86 on the left surface of the stopper member 38.

When the stopper member 38 is thus attached, the guiding part 56 of the holder member 37 is pressed leftward by the stopper member 38. This makes it possible to engage the first boss 67 and the second boss 68 with the second engagement recessed part 53 and the first engagement recessed part 48 respectively and to position the holder member 37 in the lower conveying guide 32. Further, the stopper member 38 prevents the holder member 37 from being moved with respect to the lower conveying guide 32. In addition, the movement of the stopper member 38 itself is prevented as well.

When the sheet is fed from the sheet feeding cartridge 3, the uppermost sheet is fed out by the pickup roller 33 toward between the feed roller 34 and the retard roller 35. In a case where one sheet has been fed out, the sheet is conveyed by friction between the feed roller 34 and the surface of the sheet. The retard roller 35 rotates with the conveying of the sheet because a frictional force between the retard roller 35 and a back surface of the sheet exceeds the predetermined value of the torque limiter. The sheet is then conveyed in the downstream direction through the conveying path 23 between the ribs of the upper conveying guide 31 and the guiding surface of the lower conveying guide 32. On the other hand, in a case where two or more sheets have been fed out, the uppermost sheet is conveyed by the feed roller 34; and however, since the frictional force between the uppermost sheet and a lower sheet is smaller than the frictional force between the lower sheet and the retard roller 35, no torque exceeding the predetermined torque is applied to the retard roller 35. Therefore, the retard roller 35 does not rotate, and the lower sheet is conveyed. Thus, two or more sheets are separated and only the uppermost sheet is conveyed in the downstream direction.

In addition, in a case where the sheet is fed from the lower sheet feeding cartridge 3, the sheet is conveyed in the downstream direction along the ribs 43 formed on the right surface of the lower conveying guide 32 and the ribs 93 formed on the right side surface of the stopper member 38.

Figure 9:
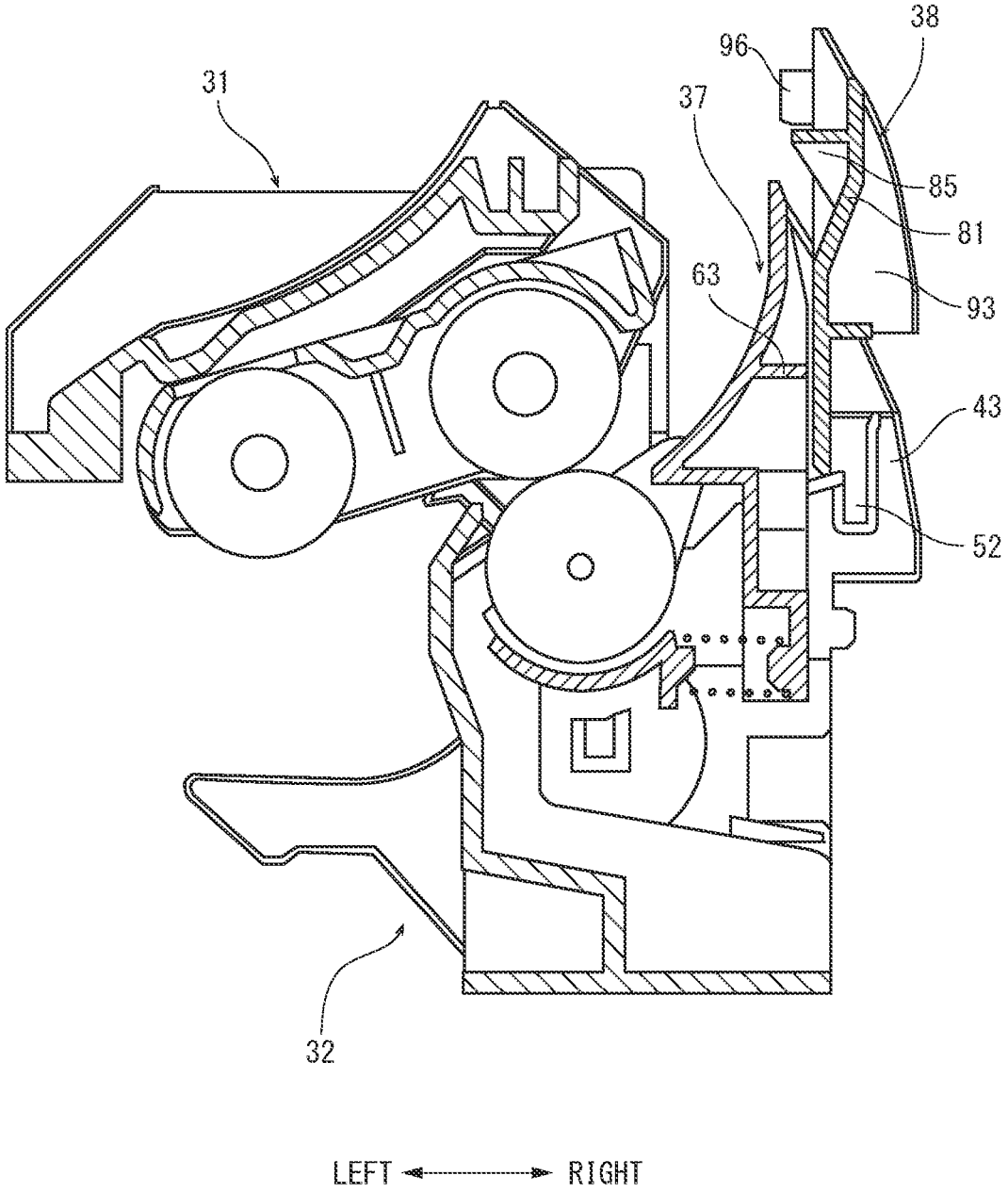
FIG. 9 is a sectional front view showing the stopper member in the middle of being detached, in the sheet feeding device according to the embodiment of the present disclosure.

Next, a procedure for maintenance or replacement of the retard roller 35 will be described with reference to FIG. 9 and FIG. 10. In the first step, the stopper member 38 is detached from the lower conveying guide 32. At this juncture, the elastic piece 81 is elastically deformed rightward to disengage the snap-fit engagement between the horizontal rib 63 and the claw part 85. Then, as shown in FIG. 9, when the stopper member 38 is slid upward, the first protruding piece 95 and the second protruding piece 96 are respectively released from the engagement groove 52 and the upper end 51*a* of the projected stripe 51. Then, the stopper member 38 is detached from the lower conveying guide 32.

Figure 10:
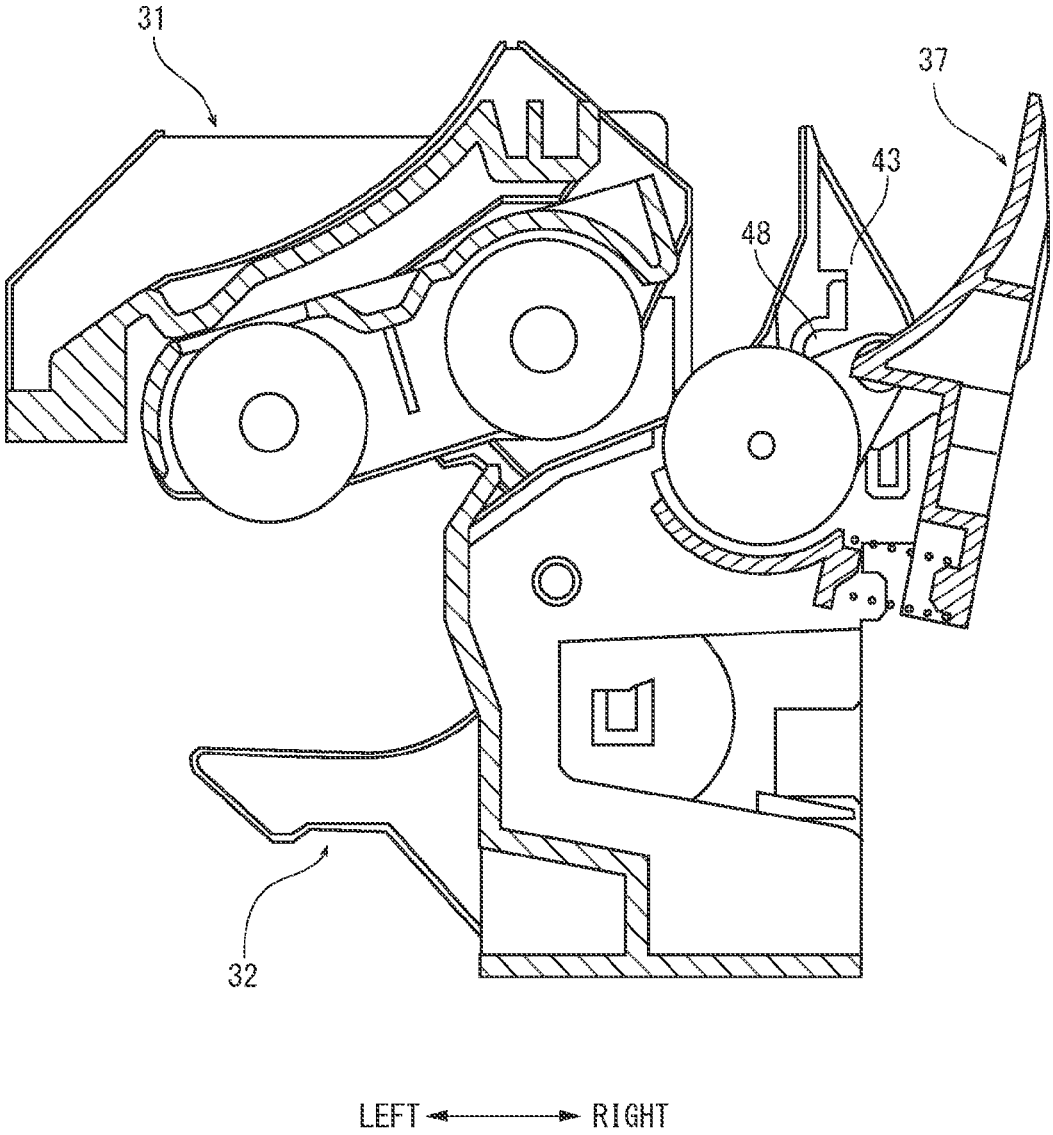
FIG. 10 is a sectional front view showing the holder member in the middle of being detached, in the sheet feeding device according to the embodiment of the present disclosure.

In the second step, as shown in FIG. 10, the holder member 37 is detached from the lower conveying guide 32. First, the second boss 68 is pulled out from the first engagement recessed part 48, and the first boss 67 is guided along the guiding groove 49 from the second engagement recessed part 53 toward the notch 47 and then pulled out from the guiding groove 49. In this manner, the holder member 37 is thereby detached from the lower conveying guide 32.

As has been described hereinabove, according to the sheet feeding device 4 of the present disclosure, the holder member 37 can be attached to or detached from the lower conveying guide 32 by the sliding operation in the vertical direction, and the stopper member 38 can be attached to or detached from the lower conveying guide 32 by the sliding operation in the vertical direction as well. Specifically, by engaging the first boss 67 and the second boss 68 which are formed on the holder member 37 with the second engagement recessed part 53 and the first engagement recessed part 48 respectively, the holder member 37 is thereby attached to the lower conveying guide 32. Afterward, the first protruding piece 95 and the second protruding piece 96 which are formed on the stopper member 38 are respectively engaged with the engagement groove 52 and the upper end 51*a* of the projected stripe 51 so that the stopper member 38 is attached to the lower conveying guide 32 on the right side of the attached holder member 37. In this manner, the stopper member 38 prevents the rightward movement of the holder member 37. Further, the snap-fitting engagement of the stopper member 38 with the holder member 37 prevents the stopper member 38 from being moved with respect to the lower conveying guide 32 together with the holder member 37 as well.

Thus, there is no need for the work of deforming the elastic piece by putting one's fingers in the small space or the like. Furthermore, the vertically sliding of the stopper member 38 prevents the movement of the holder member 37. Accordingly, there is no troublesome work associated with the attachment or detachment of the stopper member 38. Accordingly, maintenance or replacement of the retard roller 35 can be easily carried out. In addition, in order to detach the stopper member 38, since it is necessary to elastically deform the elastic piece 81 intentionally to disengage the snap-fitting engagement, it becomes possible to prevent undesirable detachment or movement of the stopper member 38, that is, undesirable detachment or movement of the holder member 37.

The attachment and detachment of the stopper member 38 and the holder member 37 is carried out in a state in which the covering member 5 provided on the right side plate of the printer main body 2 is opened. At this juncture, since it is sufficient to slide the stopper member 38 in the vertical direction, the sliding working needs a small space. This makes it possible to reduce an opening angle of the cover member 5. Therefore, there is no need to install the color printer 1 while a large space is left on the right side of the color printer 1, causing a reduced installation space of the color printer.

Further, since the ribs 93 of the stopper member 38 is formed along the guiding surface which guides the sheet conveyed from the lower sheet feeding cartridge 3, the sheet can be smoothly conveyed.

Incidentally, in the embodiment, the stopper member 38 is prevented from detaching from the lower conveying guide 32 by the engagement of the claw part 85 of the elastic piece 81 with the horizontal rib 63 of the holder member 37. However, the stopper member 38 may be directly attached to the lower conveying guide 32 in a manner capable of preventing from the detachment. For example, an engaged part is provided on both side ends in the width direction of the stopper member 38, an engaging part with which the engaged part is to be engaged is provided on both side ends in the width direction of the holder housing part 45 of the lower conveying guide 32. Then, the snap-fitting engagement of the engaged part with the engaging part can prevent the detachment of the stopper member 38 from the lower conveying guide 32. However, as in the embodiment, it is preferable that the elastic piece 81 is provided at the center in the width direction of the stopper member 38 and the elastic piece 81 is engaged with the horizontal rib 63 of the holder member 37 in the snap-fitting manner because it is sufficient to provide the engaged part and the engaging part at only one portion. This makes a simple construction and one disengagement work of the engaging part with the engaged part.

While the preferable embodiment and its modified example of the sheet feeding device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A sheet feeding device comprising:

a feeding member configured to convey an uppermost sheet in stored sheets along a conveying path;

a separating member configured to be pressed against the feeding member to separate the uppermost sheet from the other sheets;

a conveying guide configured to guide the separated sheet by the separating member along the conveying path;

a holder member configured to house the separating member and to be attached to or detached from the conveying guide by being slid in a vertical direction; and a stopper member configured to be located at a downstream side of the holder member in a conveying direction of the sheet, to be attached to or detached from the conveying guide by being slid in a vertical direction and to prevent the holder member from being moved with respect to the conveying guide, wherein the stopper member has an engaged part and the holder member or the conveying guide has an engaging part with which the engaged part is to be engaged, and the holder member is attached to the conveying guide by being slid from the above side and then the stopper member is attached to the conveying guide by being slid from the above side while engaging the engaged part with the engaging part such that the stopper member positions the holder member with respect to the conveying guide and prevents the holder member from being moved with respect to the conveying guide.

2. The sheet feeding device according to claim 1, wherein the holder member has engagement projections protruding from both side surfaces in the width direction, the conveying guide has a holder housing part in which the holder member is to be housed, the holder housing part has a pair of ribs opposing to the both side surfaces in the width direction of the holder member, the pair of ribs each have an engagement recess with which the engagement projection engages and a guiding groove which guides the engagement projection to the engagement recess, and the engagement projection is inserted into the guiding groove from the above side and then slid into the engagement recess along the guiding groove so that the holder member is attached to the conveying guide.

3. The sheet feeding device according to claim 2, wherein the guiding groove inclines downward toward the upstream side in the conveying direction, the engagement recess is formed on the upstream side end in the conveying direction of the guiding groove and an opening through which the engagement projection can be inserted is formed on the downstream side end in the conveying direction of the guiding groove.

4. The sheet feeding device according to claim 2, wherein the stopper member has protruding pieces protruding from both side surfaces thereof in the width direction, the pair of ribs each have an engagement groove with which the protruding piece is to be engaged on the downstream side in the conveying direction of the guiding groove, and the holder member is attached to the conveying guide and then the stopper member is slid from the above side while engaging the protruding piece with the engagement groove so that the stopper member is attached to the conveying guide.

5. An image forming apparatus comprising the sheet feeding device according to claim 1.

6. A sheet feeding device comprising:

a feeding member configured to convey an uppermost sheet in stored sheets along a conveying path;

a separating member configured to be pressed against the feeding member to separate the uppermost sheet from the other sheets;

a conveying guide configured to guide the separated sheet by the separating member along the conveying path;

a holder member configured to house the separating member and to be attached to or detached from the conveying guide by being slid in a vertical direction; and a stopper member configured to be attached to or detached from the conveying guide by being slid in a vertical direction outside of the holder member and to prevent the holder member from being moved with respect to the conveying guide, wherein the stopper member has an engaged part and the holder member or the conveying guide has an engaging part with which the engaged part is to be engaged, the holder member is attached to the conveying guide by being slid from the above side and then the stopper member is attached to the conveying guide by being slid from the above side while engaging the engaged part with the engaging part such that the stopper member positions the holder member with respect to the conveying guide and prevents the holder member from being moved with respect to the conveying guide, the engaged part is an elastically deformable elastic piece having a claw part at its tip end portion, the engaging part is an engaging piece with which the claw part is to be engaged, and the engaged part elastically deforms so that the claw part is engaged with the engaging part.

7. The sheet feeding device according to claim 6, wherein the engaged part is formed at a center portion of the stopper member in a width direction crossing a conveying direction of the sheet.

8. The sheet feeding device according to claim 6, wherein the claw part has an inclined surface configured to abut against the engaging part to elastically deform the engaged part when the stopper member is slid from the above side to be attached to the conveying guide.

9. An image forming apparatus comprising the sheet feeding device according to claim 6.

10. A sheet feeding device comprising:

a feeding member configured to convey an uppermost sheet in stored sheets along a conveying path;

a separating member configured to be pressed against the feeding member to separate the uppermost sheet from the other sheets;

a conveying guide configured to guide the separated sheet by the separating member along the conveying path;

a holder member configured to house the separating member and to be attached to or detached from the conveying guide by being slid in a vertical direction; and a stopper member configured to be attached to or detached from the conveying guide by being slid in a vertical direction outside of the holder member and to prevent the holder member from being moved with respect to the conveying guide, wherein the stopper member has an engaged part and the holder member or the conveying guide has an engaging part with which the engaged part is to be engaged, the holder member is attached to the conveying guide by being slid from the above side and then the stopper member is attached to the conveying guide by being slid from the above side while engaging the engaged part with the engaging part such that the stopper member positions the holder member with respect to the conveying guide and prevents the holder member from being moved with respect to the conveying guide, and the engaged part forms a guiding surface of the sheet in a state in which the stopper member is attached to the conveying guide.

* * * * *